US010765232B2

(12) United States Patent
Lai

(10) Patent No.: US 10,765,232 B2
(45) Date of Patent: Sep. 8, 2020

(54) ROTARY DISPLAY HANGER

(71) Applicant: Jin-Lan Lai, Taichung (TW)

(72) Inventor: Jin-Lan Lai, Taichung (TW)

( * ) Notice: Subject to any disclaimer, the term of this patent is extended or adjusted under 35 U.S.C. 154(b) by 0 days.

(21) Appl. No.: 16/601,914

(22) Filed: Oct. 15, 2019

(65) Prior Publication Data

US 2020/0037786 A1 Feb. 6, 2020

Related U.S. Application Data

(63) Continuation-in-part of application No. 15/969,368, filed on May 2, 2018, now abandoned.

(51) Int. Cl.

| | |
|---|---|
| ***A47F 5/00*** | (2006.01) |
| ***B65D 73/00*** | (2006.01) |
| ***A47F 7/00*** | (2006.01) |

(52) U.S. Cl.

CPC ..... *A47F 5/0006* (2013.01); *A47F 7/0021* (2013.01); *B65D 73/0064* (2013.01)

(58) Field of Classification Search

CPC ..... A47F 5/0006; A47F 7/0021; A47F 7/14; A47F 7/28; B65D 73/0064; B25H 3/00; B25H 3/006; A47B 81/005

USPC ..... 206/495, 779, 376, 375, 377, 378, 349, 206/461, 462, 464, 465, 463, 467, 471, 206/806; 81/52, 473

See application file for complete search history.

(56) References Cited

U.S. PATENT DOCUMENTS

| | | | | |
|---|---|---|---|---|
| 5,785,174 | A | 7/1998 | Chow | |
| 5,803,253 | A | 9/1998 | Zakarian | |
| 5,941,386 | A | 8/1999 | Hu et al. | |
| 6,378,700 | B1 | 4/2002 | Tong | |
| 6,837,373 | B2 | 1/2005 | Huang | |
| 6,935,516 | B2 | 8/2005 | Chiang | |
| 7,334,509 | B1 | 2/2008 | Gao | |
| 7,568,578 | B2 * | 8/2009 | Berman | A63H 17/008 206/335 |
| 7,611,013 | B2 * | 11/2009 | Leventhal | A45C 11/24 206/351 |
| 9,499,321 | B2 | 11/2016 | Ou | |
| 9,511,917 | B2 | 12/2016 | Ou | |
| 2002/0175257 | A1 | 11/2002 | Yen | |
| 2003/0062277 | A1 | 4/2003 | Chen | |

(Continued)

*Primary Examiner* — Jacob K Ackun

*Assistant Examiner* — Jenine Pagan

(74) *Attorney, Agent, or Firm* — Muncy, Geissler, Olds & Lowe, P.C.

(57) ABSTRACT

A rotary display hanger is provided, including a base, including a first receiving room and a hollow portion, the first receiving room being adapted for receiving a rotary device, the hollow portion being adapted for receiving the driving head; a position-limiting member, the position-limiting member and the base at least forming a second receiving room which is adapted for receiving the torque wrench; an index portion, received in the hollow portion, including a base portion being configured to connect with the driving head of the torque wrench and an identification portion protruding radially from the base portion, the identification portion being freely rotatable about an axis of the base portion together with the base portion and the driving head in the hollow portion; wherein each of the base portion and the identification portion is radially distanced from an inner face of the hollow portion.

11 Claims, 5 Drawing Sheets

(56) References Cited

U.S. PATENT DOCUMENTS

| | | | | |
|---|---|---|---|---|
| 2005/0067307 | A1 | 3/2005 | Kao | |
| 2007/0194204 | A1 | 8/2007 | Chang | |
| 2011/0132787 | A1 | 6/2011 | Bertken | |
| 2014/0091003 | A1 * | 4/2014 | Bradfield | B65D 75/02 206/471 |

* cited by examiner

ROTARY DISPLAY HANGER

FIELD OF THE INVENTION

The present invention is a CIP of application Ser. No. 15/969,368, filed May 2, 2018, the entire contents of which are hereby incorporated by reference.

BACKGROUND OF THE INVENTION

Description of the Prior Art

In general, sockets will be connected with a tool hanger to be displayed on the wall or board for viewing.

A conventional tool holder includes a base board and a plastic shell which is connected adhesively with the base board, the plastic shell has a receiving for totally receiving a tool inside, so as to encapsulate the tool between the base board and plastic shell. And then, the tool holder can be hanged on the wall or display frame through a hole which is disposed on the base board. However, the tool is completely sealed inside the conventional tool holder so that it cannot provide for operating and testing a function of the tool, for example, the function of a torque adjusting ring such as a smoothness of rotation, and the function of a torque wrench such as a smoothness of operation. Thus, the conventional tool holder just can only provide for viewing, but not for operation.

The present invention is, therefore, arisen to obviate or at least mitigate the above mentioned disadvantages.

SUMMARY OF THE INVENTION

An object of the present invention is to provide a rotary display hanger, which is provided for operating and testing a tool which is disposed thereinside, and provided for an index portion rotates within a hollow portion to test a function of the tool.

To achieve the above and other objects, a rotary display hanger is provided, including: a base, including a first receiving room and a hollow portion, the first receiving room and the hollow portion communicated with each other, the first receiving room being adapted for receiving a rotary device which is connected rotatably with a driving head of a torque wrench, the hollow portion being adapted for receiving the driving head; a position-limiting member, disengageably connected with the base, the position-limiting member and the base at least forming a second receiving room, one of the base and the position-limiting member having an opening which is communicated with the second receiving room; the second receiving room being adapted for receiving the torque wrench; an index portion, received in the hollow portion, including a base portion being configured to connect with the driving head of the torque wrench and an identification portion protruding radially from the base portion, the identification portion being freely rotatable about an axis of the base portion together with the base portion and the driving head in the hollow portion; wherein the first receiving room, the hollow portion and the second receiving room are arranged along the axis of the base portion, each of the base portion and the identification portion is radially distanced from an inner face of the hollow portion, and the hollow portion is radially open at two opposite sides.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
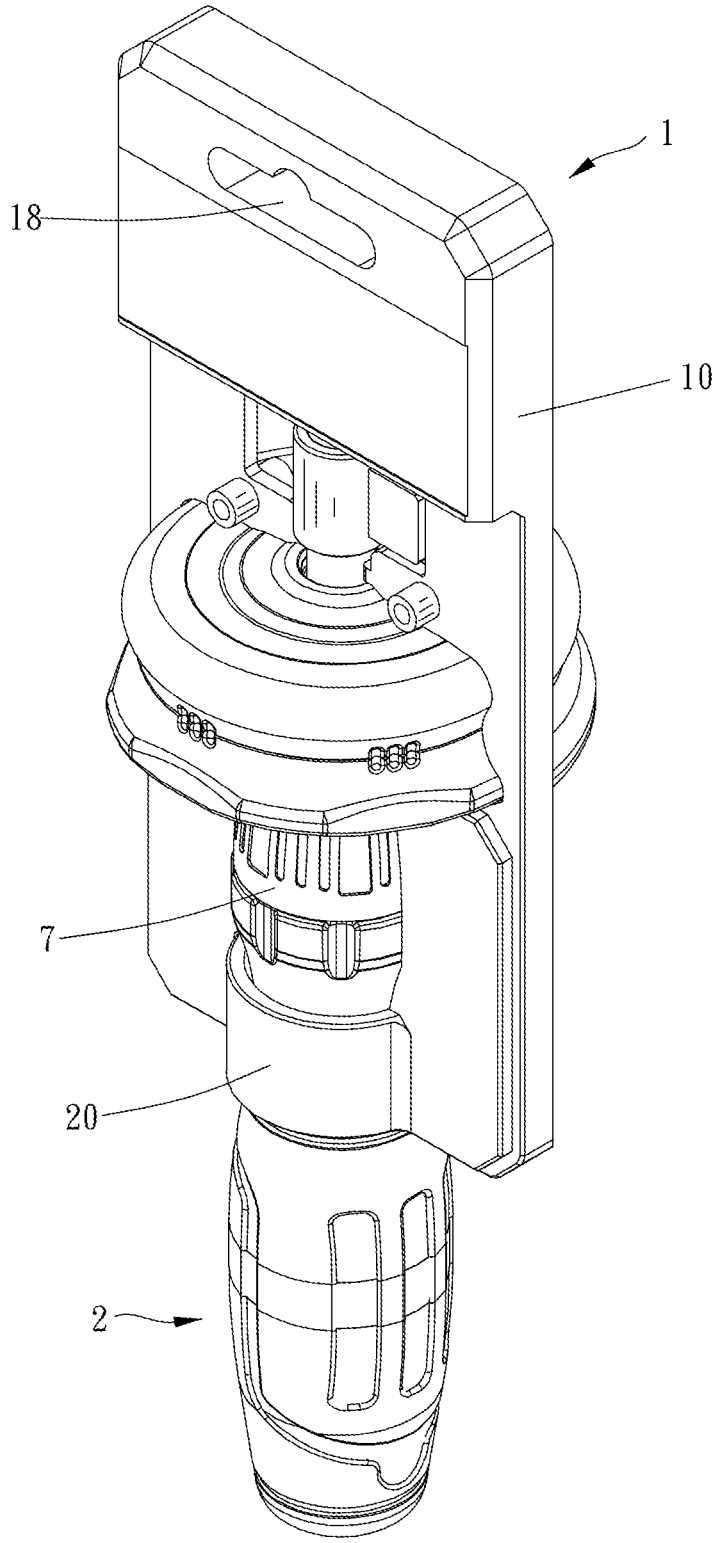
FIG. 1 is a perspective view of a rotary display hanger according to a preferred embodiment of the present invention.
Figure 3:
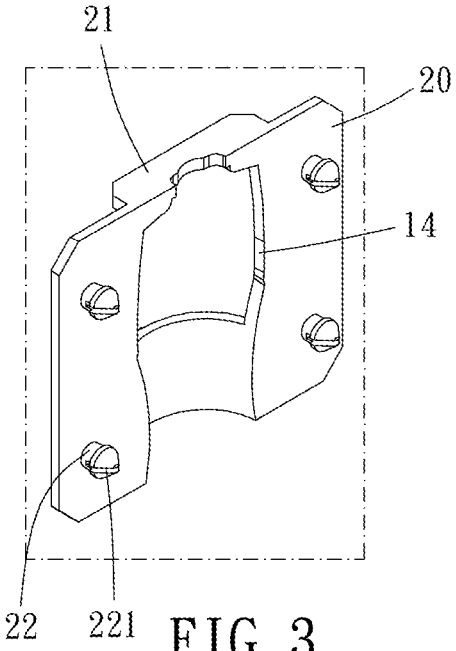
FIG. 3 is a perspective view of a position-limiting member of the preferable embodiment of the present invention.
Figure 2:
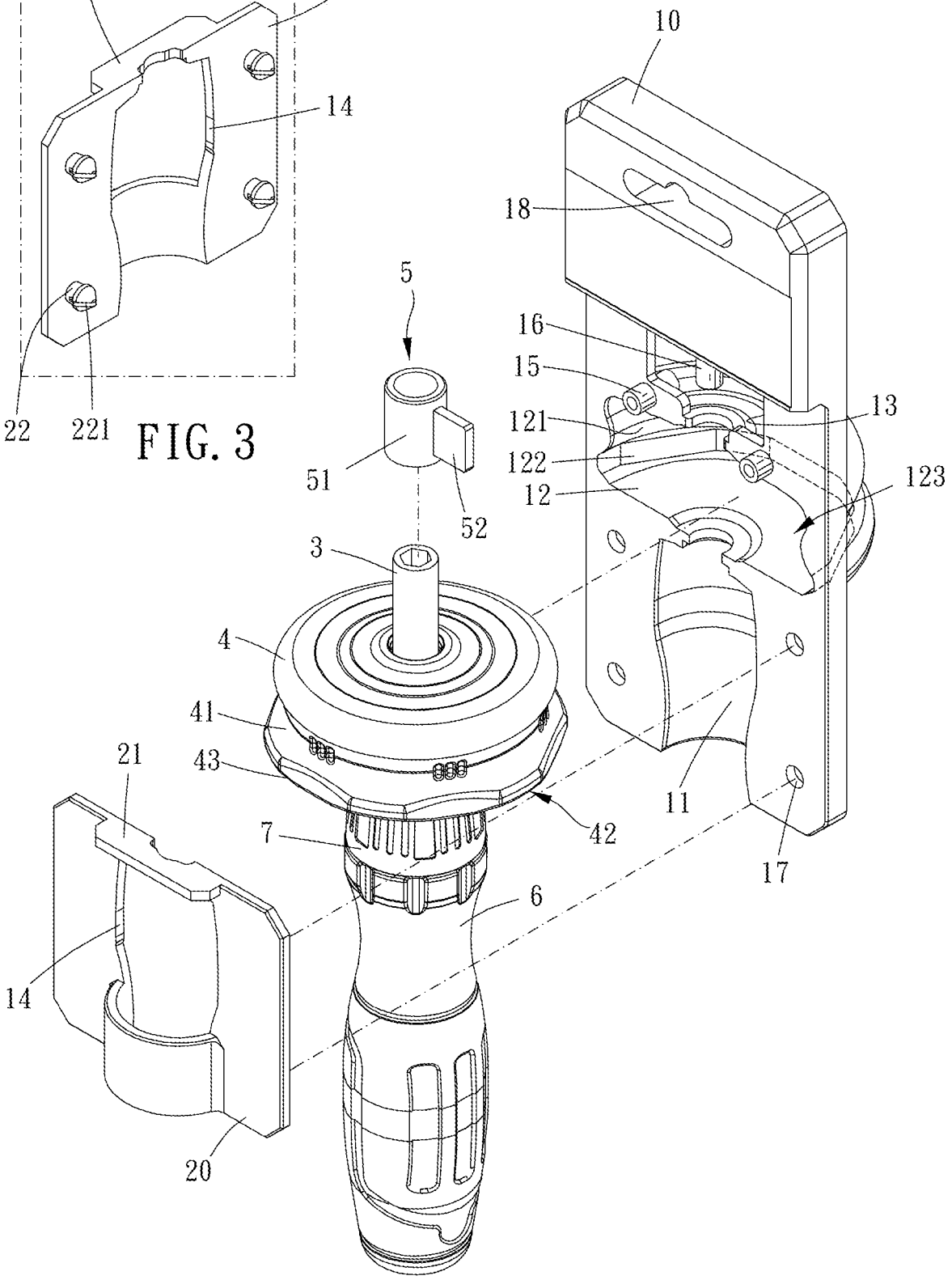
FIG. 2 is breakdown drawing of the preferable embodiment of the present invention.
Figure 4:
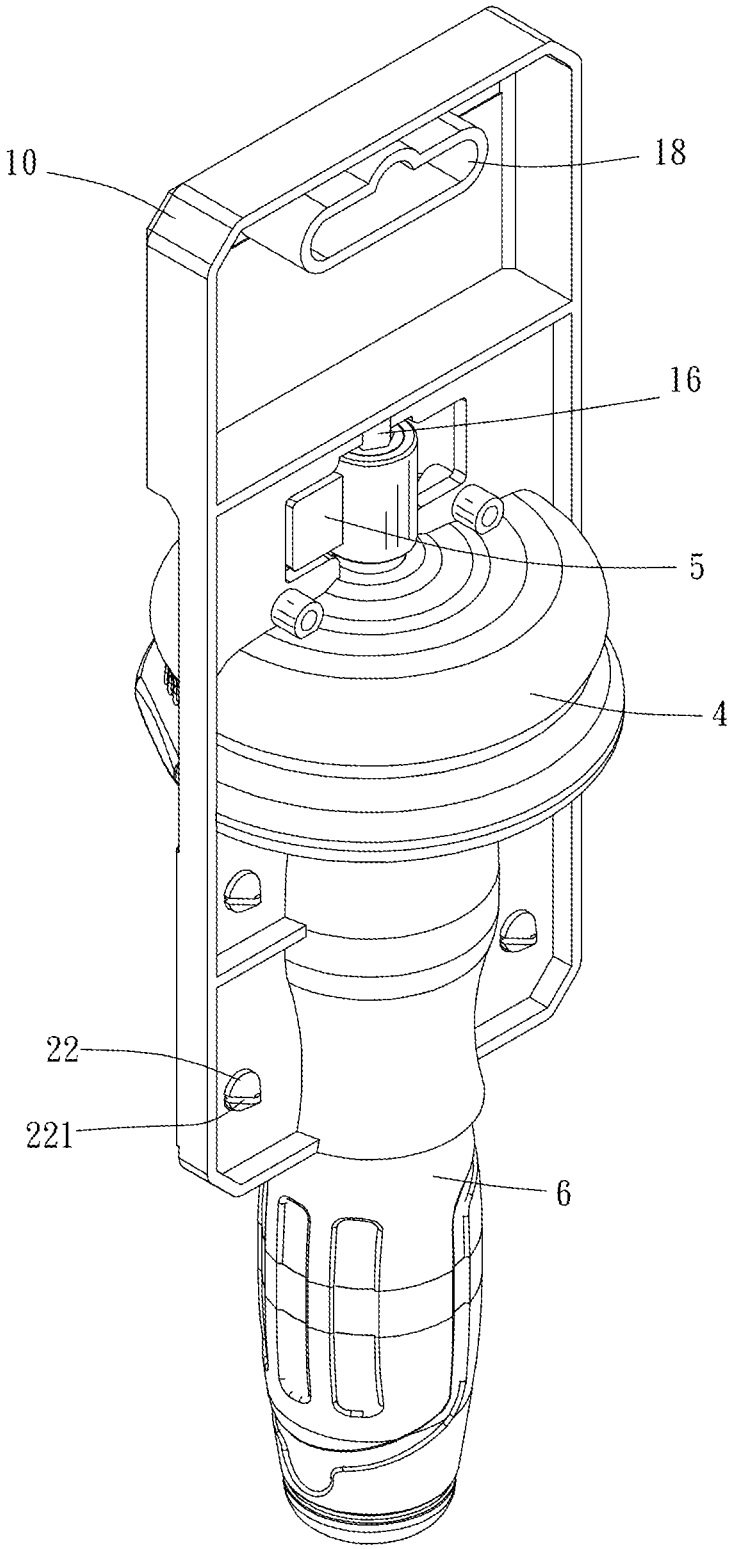
FIG. 4 is another perspective view of the rotary display hanger according to the preferred embodiment of the present invention.
Figure 5:
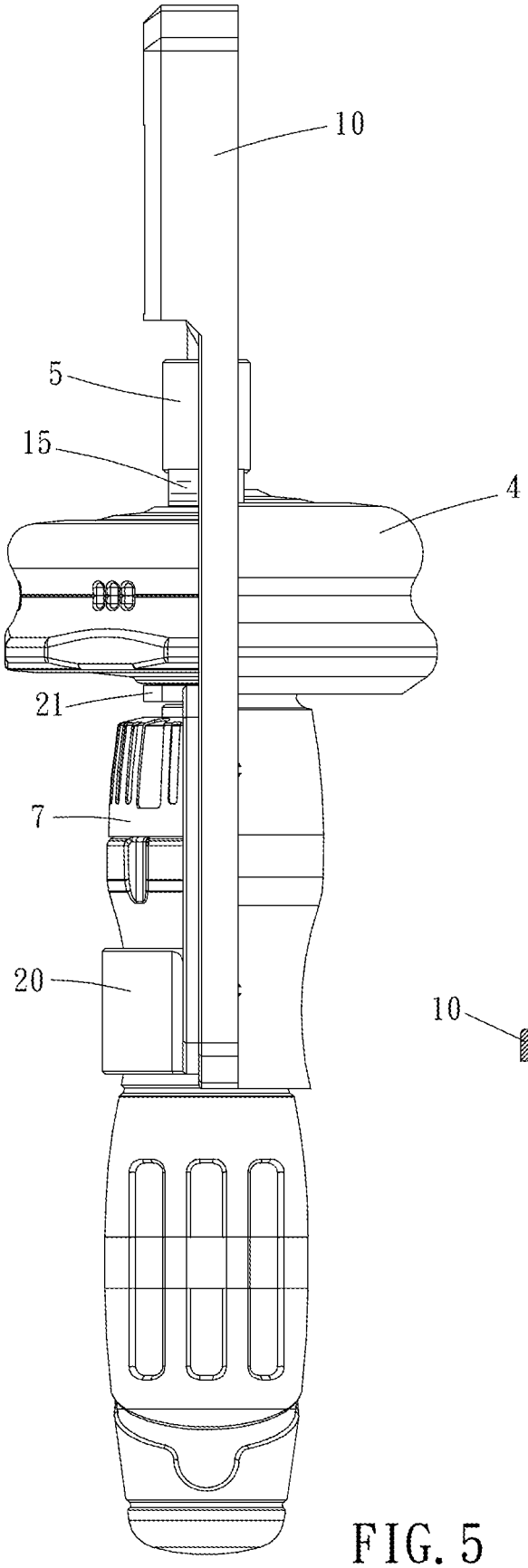
FIG. 5 is a side view of the rotary display hanger according to the preferred embodiment of the present invention.
Figure 6:
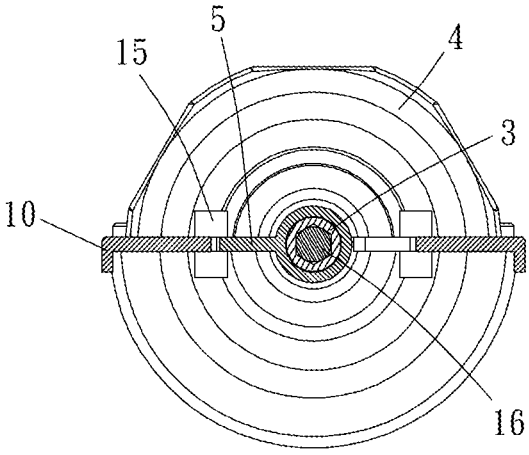
FIG. 6 is a cross-sectional view of FIG. 5.
Figure 7:
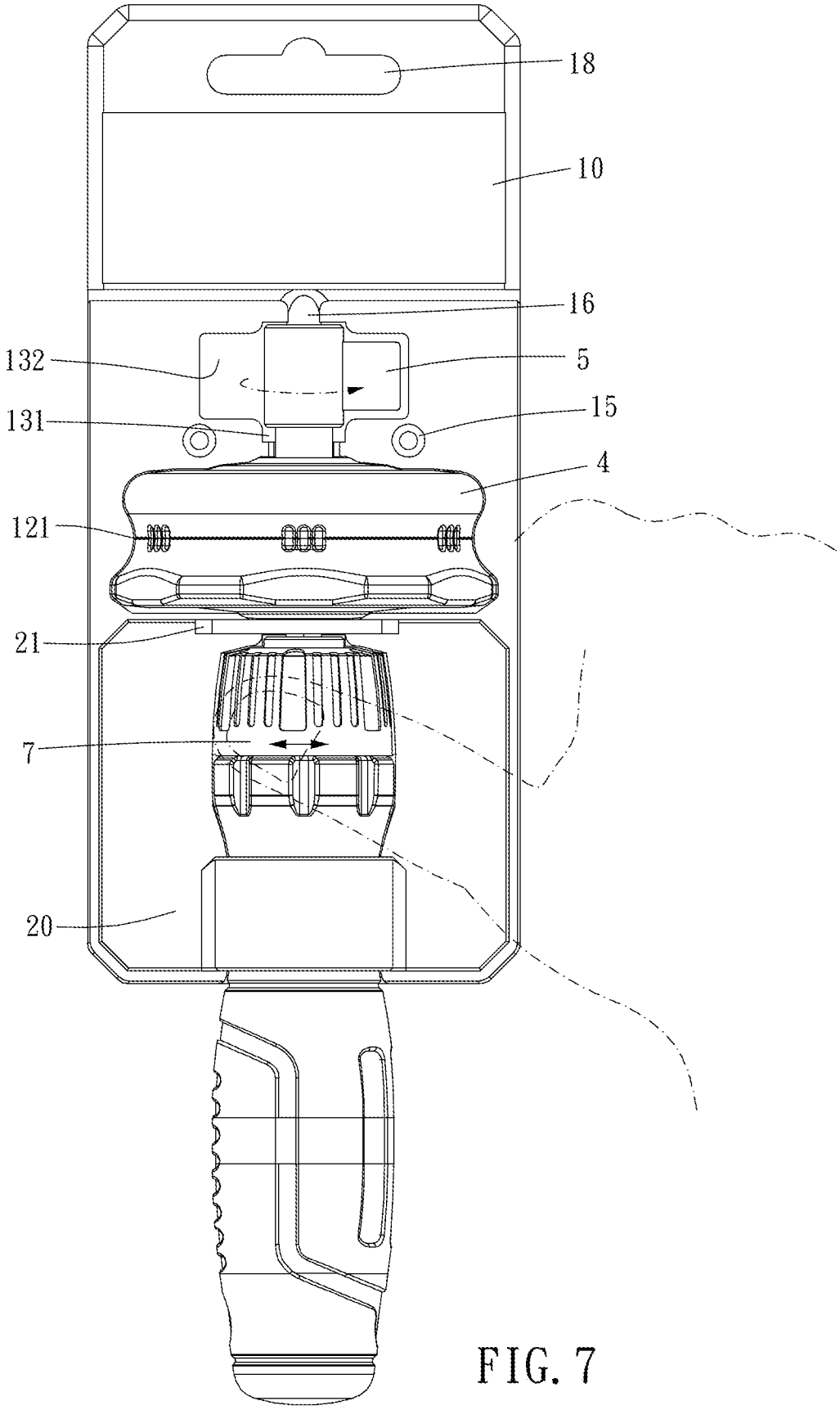
FIG. 7 is a drawing showing the preferred embodiment of the present invention in use.

FIGS. 1 to 7 show a rotary display hanger according to a preferred embodiment of the present invention. The rotary display hanger 1 includes a base 10, a position-limiting member 20, and an index portion 5.

The base 10 includes a first receiving room 12 and a hollow portion 13. The first receiving room 12 and the hollow portion 13 are connected with each other. The first receiving room 12 is adapted for receiving a rotary device 4 which is connected rotatably with a driving head 3 of a torque wrench 2. The hollow portion 13 is adapted for receiving the driving head 3.

The index portion 5 is received in the hollow portion 13, and the index portion 5 includes a base portion 51 being configured to connect with the driving head 3 of the torque wrench 2 and an identification portion 52 protruding radially from the base portion 51. The identification portion 52 is freely rotatable about an axis of the base portion 51 together with the base portion 51 and the driving head 3 in the hollow portion 13. Each of the base portion 51 and the identification portion 52 is radially distanced from an inner face of the hollow portion 13, and the hollow portion 13 is radially open at two opposite sides.

The hollow portion 13 can be partially hollowed or completely hollowed. In this embodiment, the hollow portion 13 is disposed through the base 10 in a thickness direction. In other embodiment, the hollow portion can be a perspective shell which has a chamber for receiving the index portion which is rotatable within the chamber. The position-limiting member 20 is disengageably connected with the base 10, and the position-limiting member 20 and the base 10 at least form a second receiving room 11. In this embodiment, the first receiving room 12, the hollow portion 13 and the second receiving room 11 are arranged along the axis of the base portion 51. One of the base 10 and the position-limiting member 20 has an opening 14 which is communicated with the second receiving room 11; the second receiving room 11 is adapted for receiving the torque wrench 2. In other embodiment, the position-limiting member and the base can also form the first receiving room. Thus, when the torque wrench 2 is assembled to the rotary display hanger 1, the torque wrench 2 can actually be operated and tested. Moreover, the index portion 5 can rotate inside the hollow portion 13 when testing the torque wrench 2. Specifically, the rotary display hanger 1 further includes the index portion 5. In this embodiment, the index portion 5 is a cap sleeved on the driving head 3 of the torque wrench 2. The cap has a sheet extending laterally, so as to view the rotation of the sheet easily. Besides, the sheet can be disposed a tag or a logo thereon. In other embodiment, the index portion can be a sticker such a flag sticker.

The position-limiting member 20 has the opening 14, the opening 14 corresponds to a control member 7 of the torque wrench 2, so as to expose a handle 6 of the torque wrench 2 and the control member 7 such as a rotation cap which is for gripping and operating the control member 7 to test the function. The rotary display hanger 1 further including the rotary device 4.

The first receiving room 12 has an open portion 123 which is open toward a first direction, so as to save material and to be assembled positionally the rotary device 4 inside. Besides, the position-limiting member 20 has a protruding portion 21 extending toward the first direction. Preferably, the base 10 has a plurality of protruding-limiting portions 15 which respectively protrude toward the first direction. And the protruding portion 21 and the plurality of protruding-limiting portions 15 is configured to restrict the rotary device 4 therebetween, so as to support the rotary device 4; thus, the rotary device 4 can be rotated relative to the first receiving room 12 stably. Besides, the first receiving room 12 has an annular convex 121 extending inward. Wherein the annular convex 121 can extend continuously or non-continuously, so that an annular cavity portion 41 of the rotatory device 4 that corresponds to the annular convex 121 in shape can be engaged with the annular convex 121 for positioning without shaking and being disengaged from the direction which is transverse to the first direction. Moreover, the rotary device 4 has an annular protruding portion 42, the annular protruding portion 42 has a plurality of first planes 43 which are arranged in a periphery direction, an inner wall of the first receiving room 12 has a plurality of second planes 122 which are engaged with the plurality of first planes 43. Wherein, every two adjacent of the first planes 43 are arranged in non-parallel. Every two adjacent of the second planes 122 are arranged in non-parallel. Thus, the rotary device 4 can be engaged within the first receiving room 12 without rotating. In other embodiment, the plurality of first plans can be arc-shape planes, tooth-shaped planes, other non-circular planes, or a shape of each second planes corresponds to each first planes.

The base 10 further includes a positioning protruding portion 16 which extends into the hollow portion 13. Therefore, the positioning protruding portion 16 is adapted for the index portion 5 sleeves thereon. Preferably, the hollow portion 13 includes a wide section 132 and two narrow sections 131 which are disposed two opposite sides of the wide section 132. The positioning protruding portion 16 extends into the wide section 132, so as to limit the index portion 5 inside the wide section 132, furthermore, the index portion 5 can be rotated about the positioning protruding portion 16 as an axle for rotating smoothly and without shifting.

One of the base 10 and the position-limiting member 20 has a plurality of male connection portions, the other of the base 10 and the position-limiting member 20 has a plurality of female connection portions which are releasably engaged with the plurality of male connection portions. Each of the plurality of male connection portions is a resilient tapered cone, and each of the plurality of the female connection portions is a hole. In this embodiment, the base 10 has the plurality of female connection portions 17, the position-limiting member 20 has the plurality of male connection portions 22. Specifically, the resilient tapered cone can be made of elastic material, such as elastic plastic and rubber, for flexible resetting after being pressed or deformed. In this embodiment, the resilient tapered cone has a groove 221 which extends along an axial direction, so that the resilient tapered cone can be deformed by pressing toward the groove 221 to be disposed through the hole for positioning engageably.

Besides, the base 10 has a hanging hole 18 for hanging.

In use, the torque wrench 2 can be gripped and the control member 7 of the torque wrench can be adjusted to adjust a direction of the driving head 3 of a torque wrench 2 actually through the opening 14. The first receiving room 12 is adapted for receiving the rotary device 4 which is sleeved on the driving head 3 of the torque wrench 2. When operating the handle 6, it is easy to view the rotation of the index portion 5 which is disposed on the driving head 3 through the hollow portion 13. As a result, the torque wrench 2 can be operated and tested the function actually when assembling to the rotary display hanger 1. Moreover, the index portion 5 can be rotated within the hollow portion 13 when testing the tool.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A rotary display hanger, including:

a base, including a first receiving room and a hollow portion, the first receiving room and the hollow portion communicated with each other, the first receiving room being adapted for receiving a rotary device which is connected rotatably with a driving head of a torque wrench, the hollow portion being adapted for receiving the driving head;

a position-limiting member, disengageably connected with the base, the position-limiting member and the base at least forming a second receiving room, one of the base and the position-limiting member having an opening which is communicated with the second receiving room; the second receiving room being adapted for receiving the torque wrench;

an index portion, received in the hollow portion, including a base portion being configured to connect with the driving head of the torque wrench and an identification portion protruding radially from the base portion, the identification portion being freely rotatable about an axis of the base portion together with the base portion and the driving head in the hollow portion;

wherein the first receiving room, the hollow portion and the second receiving room are arranged along the axis of the base portion, each of the base portion and the identification portion is radially distanced from an inner face of the hollow portion, and the hollow portion is radially open at two opposite sides.

2. The rotary display hanger of claim 1, wherein the position-limiting member has the opening, and the opening corresponds to a control member of the torque wrench.

3. The rotary display hanger of claim 1, wherein the first receiving room has an open portion which is open toward a first direction.

4. The rotary display hanger of claim 3, wherein the position-limiting member has a protruding portion extending toward the first direction.

5. The rotary display hanger of claim 4, wherein the base has a plurality of protruding-limiting portions which respectively protrude toward the first direction, and the protruding portion and the plurality of protruding-limiting portions are configured to restrict the rotary device therebetween.

6. The rotary display hanger of claim 1, wherein one of the base and the position-limiting member has a plurality of male connection portions, the other of the base and the position-limiting member has a plurality of female connection portions which are releasably engaged with the plurality of male connection portions, each of the plurality of male connection portions is a resilient tapered cone, and each of the plurality of the female connection portions is a hole.

7. The rotary display hanger of claim 1, wherein the base further includes a positioning protruding portion which extends into the hollow portion.

8. The rotary display hanger of claim 7, wherein the hollow portion includes a wide section and two narrow sections which are disposed on two opposite sides of the wide section, and the positioning protruding portion extends into the wide section.

9. The rotary display hanger of claim 1, wherein the first receiving room has an annular convex extending inward.

10. The rotary display hanger of claim 1, further including the rotary device, the rotary device having an annular protruding portion, the annular protruding portion having a plurality of first planes which are arranged in a periphery direction, an inner wall of the first receiving room having a plurality of second planes which are engaged with the plurality of first planes.

11. The rotary display hanger of claim 5, wherein the position-limiting member has the opening, the opening corresponds to a control member of the torque wrench; one of the base and the position-limiting member has a plurality of male connection portions, the other of the base and the position-limiting member has a plurality of female connection portions which are releasably engaged with the plurality of male connection portions, each of the plurality of male connection portions is a resilient tapered cone, and each of the plurality of the female connection portions is a hole; the resilient tapered cone has a groove which extends along an axial direction; the base further includes a positioning protruding portion which extends into the hollow portion; the hollow portion includes a wide section and two narrow sections which are disposed two opposite sides of the wide section, the positioning protruding portion extends into the wide section; the first receiving room has an annular convex extending inward; the base has a hanging hole; the rotary display hanger further includes the index portion.

* * * * *